United States Patent [19]

Grunert et al.

[11] Patent Number: 4,683,451

[45] Date of Patent: Jul. 28, 1987

[54] CIRCUIT BREAKER WITH TRIP DELAY MAGNETIC CIRCUIT

[75] Inventors: Kurt A. Grunert, Beaver Boro; Alfred E. Maier, Chippewa, both of Pa.

[73] Assignee: Westinghouse Electric Corp., Pittsburgh, Pa.

[21] Appl. No.: 839,484

[22] Filed: Mar. 14, 1986

[51] Int. Cl.[4] ..... H01H 9/00

[52] U.S. Cl. ..... 335/174; 335/41; 335/59; 335/63

[58] Field of Search ..... 335/41, 59, 63, 172, 335/173, 174, 239

[56] References Cited

U.S. PATENT DOCUMENTS

| | | | |
|---|---|---|---|
| 4,062,052 | 12/1977 | Harper et al. | 335/63 |
| 4,220,935 | 9/1980 | Wafer et al. | 335/38 |
| 4,503,408 | 3/1985 | Mrenna et al. | 335/35 |

FOREIGN PATENT DOCUMENTS

| | | | |
|---|---|---|---|
| 243899 | 12/1965 | Austria | 335/59 |

*Primary Examiner*—E. A. Goldberg
*Assistant Examiner*—Lincoln Donovan
*Attorney, Agent, or Firm*—L. P. Johns

[57] ABSTRACT

A circuit breaker with a magnetic circuit for delaying the trip function and characterized by a dual variable magnetic circuit air gap which allows a time delay at low level overcurrents, such that motor starting transient currents do not prematurely trip the circuit breaker.

2 Claims, 3 Drawing Figures

CIRCUIT BREAKER WITH TRIP DELAY MAGNETIC CIRCUIT

CROSS REFERENCE TO RELATED APPLICATION

This application is related to the copending application Ser. No. 845,302, filed Mar. 27, 1986, entitled Circuit Breaker with Impact Trip Relay, of K. A. Grunert and J. R. Farley; and Ser. No. 862,090, filed May 12, 1986, entitled "Circuit Breaker With Visible Trip Indicator", of W. W. Long, W. E. Beatty, and J. A. Wafer.

BACKGROUND OF THE INVENTION

1. Field of the Invention

This invention relates to a circuit breaker within an insulating housing, and more particularly, it pertains to a magnetic circuit air gap adapted, at low lever overcurrents, to avoid premature tripping of the circuit breaker.

2. Description of the Prior Art

For some applications, it is desirable to provide a circuit breaker having a variable magnetic circuit air gap to obtain a time delay effect. For example, for a motor circuit protection it is desirable that a circuit breaker includes a magnetic circuit adapted to enable a delay of the trip function at low level overcurrent conditions so that motor starting transient currents do not prematurely trip the circuit breaker.

Heretofore, manual means for selectively adjusting the overcurrent valve for tripping a circuit breaker have been provided. However, such means have not been completely suitable for all applications because a motor starting current typically includes an inrush current pulse that can be up to twice the value of normal starting current of the motor. Since magnetic tripping devices are usually designed to trip or operate according to starting current values, the inrush pulse can be quite disruptive to the function of the tripping device.

SUMMARY OF THE INVENTION

A circuit breaker is provided which comprises an insulating housing containing a circuit breaker mechanism having a pair of separable contacts including a movable contact; a movable contact arm carrying the movable contact and movable between open and closed positions of the contacts; an operating mechanism for actuating the contact arm and comprising a pivotally supported releasable member; latching means for latching the releasable member and including a latch lever movable between latched and unlatched positions of the member; trip means including a trip bar for releasably holding the latch lever in the latched position; trip delay means for avoiding premature unlatching of the trip bar and including electromagnetic means and an armature; and the armature being movable preliminarily to operation of the electromagnetic means in response to an overcurrent below a predetermined overcurrent condition.

The advantage of this device is that the trip delay overrides motor transients, but the magnetic circuit trips on short circuit on the instantaneous fault.

DESCRIPTION OF THE PREFERRED EMBODIMENT

Figure 1:
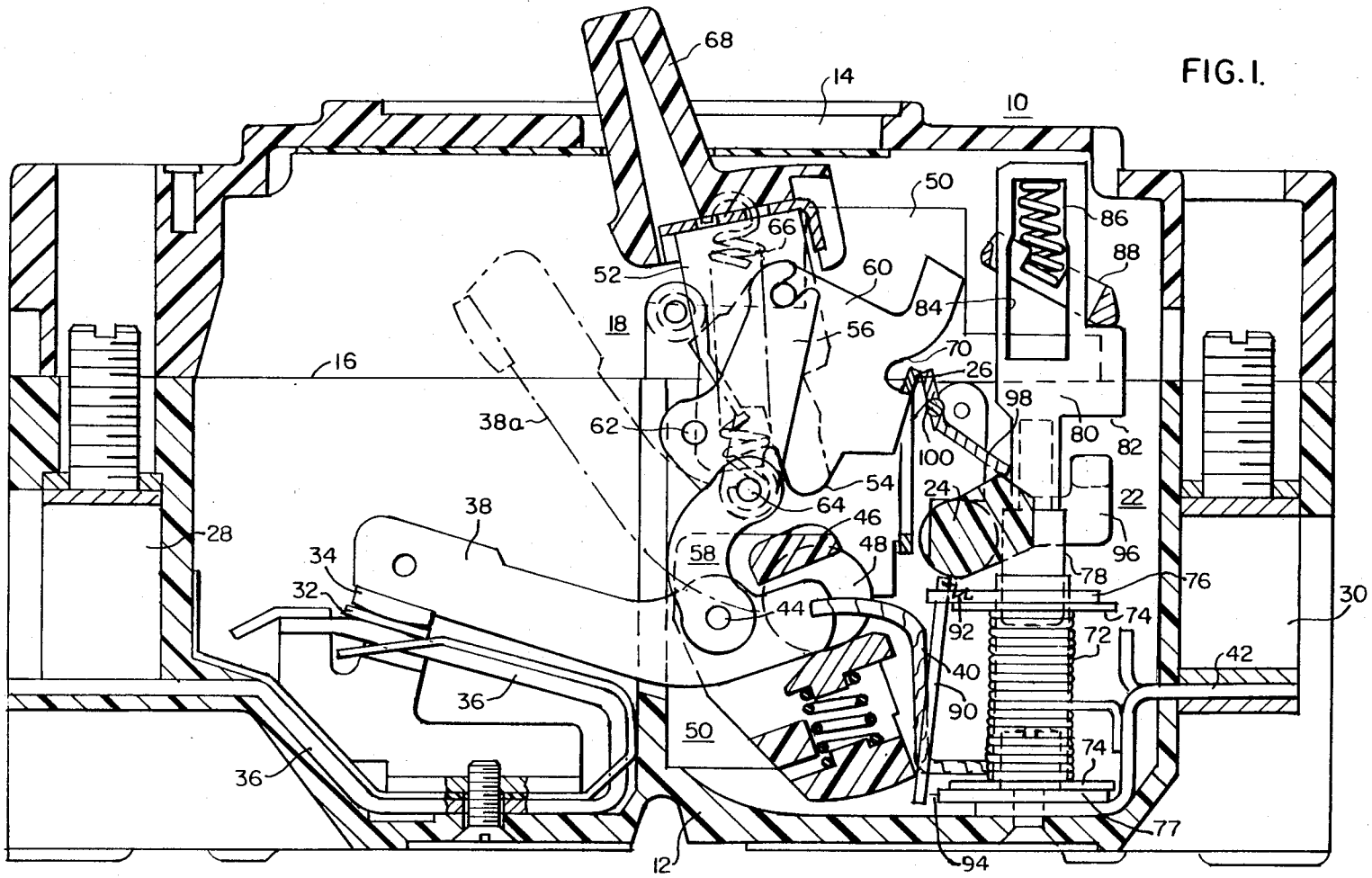
FIG. 1 is a vertical sectional view through the center pole of a multi-pole circuit breaker with the trip delay magnetic circuit mechanism shown in elevation.

In FIG. 1 a molded case circuit breaker is generally indicated at 10 and it comprises an insulating housing or base 12 having a cover 14 which is mechanically attached at a parting line 16 where the cover is retained in place by a plurality of fasteners, such as screws (not shown). The circuit breaker may be of a single or multiple pole construction. The latter construction comprises insulating barriers separating the interior of the housing into adjacent side-by-side pole unit compartments in a well known manner. For a multiple pole unit, such as a three-pole circuit breaker, an operating mechanism 18 is disposed in the center pole unit. However, each pole unit includes a separate trip delay device 22 for rotating a trip bar 24 which in turn releases a latch lever 26.

For a polyphase circuit breaker, a pair of similar terminals including line terminal 28 and load terminal 30, at opposite ends of the housing 10, are provided for each phase. The terminals 28, 30 are employed to serially electrically connect the circuit breaker 10 into an electrical circuit such as a three-phase circuit, to protect the electrical system involved.

The circuit breaker 10 is disclosed (FIG. 1) in the closed position with a pair of separable contacts including a fixed contact 32 and a movable contact 34 in electrical contact with each other. In that position, a circuit through the circuit breaker extends from the line terminal 28 through a conductor 36, the contacts 32, 34, a contact arm 38, a shunt 40, a coil 72 in the trip delay device 22, and a conductor 42 to the load terminal 30.

The contact arm 38 is pivotally connected at a pin 44 to a rotatable carriage 46, which is secured to or integral with a crossbar 48. The contact arm 38 and the carriage 46 rotate as a unit with the crossbar 48 during normal current conditions through the circuit breaker 10. The operating mechanism 18 is typical of that set forth in U.S. Pat. No. 4,503,408 for which reason it is not described herein in detail. Suffice it to say, the mechanism 18 is positioned between spaced plates 50 (one of which is shown) which are fixedly secured to base 12 of the center pole unit. An inverted U-shaped operating lever 52 is pivotally supported in U-shaped notches 54 on the plates with the ends of the legs of the lever supported in the notches 54 of the plates.

The operating mechanism 18 includes an over center toggle having an upper toggle link 56 and a lower toggle link 58 which connect a contact arm 38 to a releasable cradle member 60 that is pivotally supported on the plates 50 by a pin 62. The toggle links 58, 56 are pivotally connected by means of a knee pivot pin 64. Over center operating springs 66 are connected under tension between the knee pivot pin 64 and the bight portion of the lever 52. A handle 68 is mounted on the upper end of the lever 52 for manual operation of the operating mechanism 18.

Contacts 32, 34 are normally manually separated by movement of the handle 68 in the rightward direction from the position shown in FIG. 1 from the ON to the OFF position. However, inasmuch as the latch lever 26 of the trip delay device 22 engages a notch 70 of the cradle number 60, the circuit breaker 10 is in the untripped position as shown in FIG. 1. For the purpose of this invention, the circuit breaker operation mechanism 18 is shown as being tripped solely by the trip device 22. Other means for tripping such as separate high speed electromagnetic trip devices are described elsewhere such as in U.S. Pat. No. 4,220,935.

In accordance with this invention, when the operation mechanism 18 is tripped, by whatever means such as the trip device 22, the contact arm 38 moves to a broken line position 38*a*. The magnetic circuit design of this invention permits a delay of the trip function, at low lever overcurrents, such that motor starting transient currents, will not prematurely trip the circuit breaker. The trip delay magnetic device 22 delays a mechanical motion after the application of an electrical impulse by means of a dual magnetic field gap change. For that purpose, the time delay magnetic device 22 includes an electromagnetic solenoid including the coil 72, wrapped within a bobbin 74 which in turn is mounted within spaced frame members 76, 77, and an armature 78. The upper end of the armature 78 is secured within a body 80. The body 80 includes a projection or hammer 82. In addition, the body 80 includes a window 84 in which a coil spring 86 is seated which spring is supported at the lower end on a member 88 for holding a solenoid in the withdrawn position (FIG. 1) under normal current operating conditions.

The trip delay magnetic device 22 also includes an armature 90, the upper end of which is pivotally mounted on the frame member 76 and the lower end of which is normally spaced from the end of the frame member 77 by a coil spring 92.

Under normal current conditions the trip delay magnetic device 22 is sustained in the condition shown in FIG. 1, that is, current passing from the shunt 40 passes through the coil 72 to the conductor 42 without attracting the armature 78 downwardly into the coil.

When an overcurrent of a predetermined magnitude occurs, an electromagnetic force of sufficient value occurs within the frame member 76, 77 and attracts the armature 90 toward the frame member 77, thereby closing the gap 94 between them and overcoming the force of the spring 92. In response to that action, the augumented electromagnetic force draws the solenoid armature into the coil 72 (FIG. 2) causing the hammer 82 to strike an arm 96 of the trip bar 24 to rotate the trip bar sufficiently to permit a lever 98 to rotate about a pivot 100 and thereby release the latch lever 26 from the notch 70 of the cradle member 60, causing tripping of the circuit breaker mechanism and raising the contact arm to the open position 38*a*.

Manifestly, when the contacts 32, 34 are separated, the electromagnetic force in the solenoid subsides and the spring 86 draws the armature 78 to the retracted position (FIG. 1). At the same time, the armature 90, under the force of the spring 92, returns to the retracted position of FIG. 1.

Figure 2:
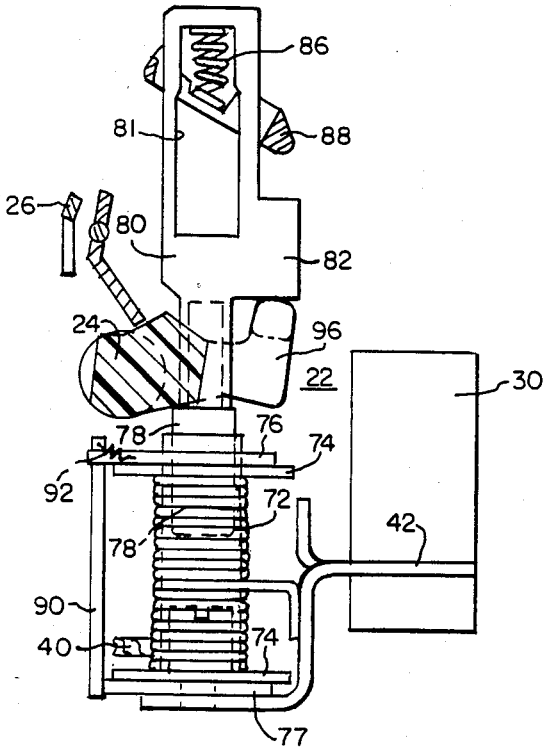
FIG. 2 is a fragmentary sectional view of the trip delay magnetic circuit mechanism in the tripped position.
Figure 3:
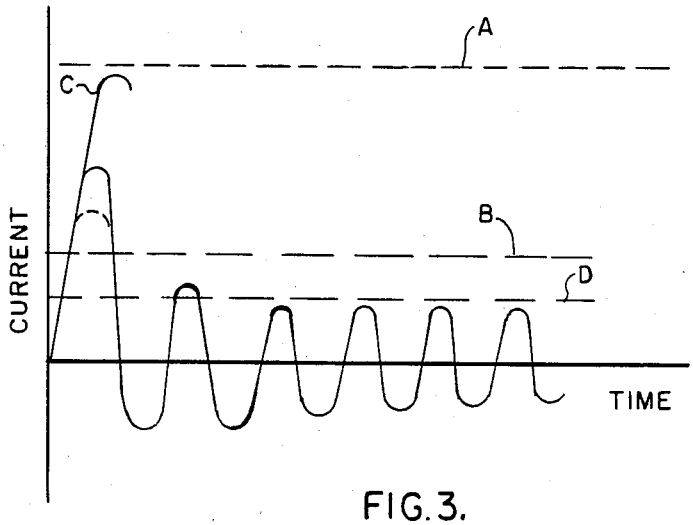
FIG. 3 is a graph of the sine-wave curve of alternating current, showing the effect of a mechanical time delay magnetic circuit on a fault current.

In FIG. 3 a sine-wave curve representing the AC current of a typical motor starting current is shown. Without the delay action of the armature 78 moving to the closed position (FIG. 2), a magnetic trip level of, say 10 times the lock rotor current, may have to be set at a level A to avoid a possible high fault current C. Where, however, the armature 90 is included in the circuit, the time delay involved in closing the armature 90 to the position shown in FIG. 2 is sufficient for the high fault current C to subside before a nuisance trip of the circuit breaker occurs. For that reason, a magnetic trip setting at B of, say only 2 times the lock rotor current D, may be established in order to provide better protection when the motor is running. A standard solenoid has a stationary core member and a moving armature magnetically activated by the coil. The force attraction between the core and armature is given by the equation:

$$F = KB^2 A.$$

where

B = Magnetic field density in the air gap.

A = Effective pole face area.

The magnetic field density is related to the coil and current. The force relates the load and the solenoid force with the air gap 94. Thus, for a given load, sufficient magnetic field density must be developed to generate the required force. Typical magnetic solenoids operate in this manner. The time for the armature 90 to move from the open to closed positions is derived from the acceleration equation F = ma, and depends on the moving mass, gap, load, as well as the magnetic driving force.

The device of this invention involves two variable air gaps in the magnetic gap including the path 94 and the gap within the coil through which the armature 78 moves. The general equation for B is given in terms of the magnetic field path. The two air gaps are represented by R1 and R2, respectively. Operation is such that on the application of a current, the B1 generated develops a force $F1 = KB^2A$, which force is sufficient to cause the armature 90 to move and close the gap 94. The value R2 becomes effectively zero. Time passes while R1 is reduced to zero and the magnetic field in the circuit changes from B1 to B2. A force equal to or greater than the B2 field density develops a sufficient value to begin to close the air gap within the coil and provide the mechanical action of the armature 90, thereby tripping the circuit breaker latch mechanism. Thus, a mechanical time delay is introduced between the moment when the current is first applied and the time that the second moving solenoid 78 operates.

Where high current (fault levels) occur, the magnetic field density is high enough to actuate the armature 78 without action of the armature 90.

Accordingly, the trip delay mechanism overrides the motor transient currents, but the magnetic circuit will trip on short circuit current on an instantaneous fault.

What is claimed is:

1. A circuit breaker comprising:

a pair of separable contacts including a movable contact;

a movable contact arm carrying the movable contact and movable between open and closed positions of the contacts;

an operating mechanism for actuating the contact arm and comprising a pivotally supported releasable member;

latching means for latching the releasable member and including a latch lever movable between latched and unlatched positions of the releasable member;

trip means including a trip bar for releasably holding the latch lever in the latched position;

trip delay means for avoiding premature unlatching of the trip bar and including first electromagnetic means including a first armature and second electromagnetic means including a second armature and a solenoid coil; the first armature being movable preliminary to operation of the second armature in response to an overcurrent below a predetermined overcurrent condition; and the second electromagnetic means also including a magnetic frame having opposite end portions each disposed at opposite ends of the coil and including the second armature pivotally mounted on one end portion and movable into and out of contact with the other end portion in response to a magnetic force, so as to enhance the electromagnetic force acting on the second armature.

2. The circuit breaker of claim 1 in which the second armature is biased in a position corresponding to the latched position.

* * * * *